US007118348B2

(12) United States Patent
Dean et al.

(10) Patent No.: US 7,118,348 B2
(45) Date of Patent: Oct. 10, 2006

(54) COMPRESSED AIR SYSTEM AND METHOD OF CONTROL

(75) Inventors: Jason Arthur Dean, Erie, PA (US); Mark Alan Linebach, Erie, PA (US); Richard Gerald Bliley, Erie, PA (US); Stephen Matthew Pelkowski, Erie, PA (US); Jeffrey James Kisak, Erie, PA (US)

(73) Assignee: General Electric Company, Schenectady, NY (US)

( * ) Notice: Subject to any disclaimer, the term of this patent is extended or adjusted under 35 U.S.C. 154(b) by 360 days.

(21) Appl. No.: 10/770,945

(22) Filed: Feb. 3, 2004

(65) Prior Publication Data

US 2004/0175273 A1 Sep. 9, 2004

Related U.S. Application Data

(60) Provisional application No. 60/452,621, filed on Mar. 6, 2003.

(51) Int. Cl.
*F04B 49/03* (2006.01)
*F04B 49/08* (2006.01)

(52) U.S. Cl. ..... 417/12; 417/28; 417/44.2

(58) Field of Classification Search ..... 417/12, 417/26, 28, 44.2
See application file for complete search history.

(56) References Cited

U.S. PATENT DOCUMENTS 1,521,034 A * 12/1924 Maxson ..... 417/12
3,782,858 A * 1/1974 Deters ..... 417/26
3,860,363 A * 1/1975 Silvern et al. ..... 417/12
4,149,827 A * 4/1979 Hofmann, Jr. ..... 417/12
4,201,517 A * 5/1980 Ferguson ..... 417/12
4,819,123 A * 4/1989 Hatimaki ..... 417/26
4,863,355 A * 9/1989 Odagiri et al. ..... 417/12
6,004,103 A 12/1999 Fisher et al.
6,027,311 A 2/2000 Hill et al.
6,068,447 A * 5/2000 Foege ..... 417/12
6,126,402 A 10/2000 Fisher et al.
6,276,281 B1 8/2001 Mesalic et al.
6,390,779 B1 5/2002 Cunkelman
6,561,766 B1 * 5/2003 Nishimura et al. ..... 417/44.2
6,595,757 B1 * 7/2003 Shen ..... 417/44.2
6,599,093 B1 * 7/2003 Totsuka ..... 417/28

* cited by examiner

*Primary Examiner*—Michael Koczo, Jr.
(74) *Attorney, Agent, or Firm*—Carlos Hanze, Esq.; Enrique J. Mora, Esq.; Beusse Wolter Sanks Mora & Maire, P.A.

(57) ABSTRACT

A compressed air system, wherein a decision to de-energize a compressor motor is made with consideration of the likely need for the operation of the compressor at a future point in time. A rate of pressure decay in an air reservoir may be extrapolated over a predetermined time period to predict the need for operation of the compressor within the time period. If operation of the compressor is predicted to be needed within the time period, the compressor is allowed to continue to run in an unloaded mode beyond a normal cool down period.

11 Claims, 2 Drawing Sheets

COMPRESSED AIR SYSTEM AND METHOD OF CONTROL

This application claims priority to a provisional application filed on Mar. 6, 2003, having application No. 60/452,621, which is incorporated herein by reference.

FIELD OF THE INVENTION

This invention relates generally to compressed air systems, and more particularly to a compressed air system for a locomotive.

BACKGROUND OF THE INVENTION

Compressed air systems are used to provide energy for driving a variety of devices in a variety of applications. One such application is a railroad locomotive where compressed air is used to power locomotive air brakes and pneumatic control systems.

A typical compressed air system will include a reservoir for storing a volume of compressed air. A motor-driven compressor is used to maintain the air pressure in the reservoir within a desired range of pressures. The reservoir pressure may be higher than the demand pressure for a device supplied by the system, in which case a pressure regulator may be used to reduce the pressure supplied to the device. The stored volume of compressed air in the reservoir provides an inertia that allows the compressor to be sized smaller than would otherwise be necessary if the compressor supplied the individual devices directly. Furthermore, the stored volume of compressed air in the reservoir allows the compressor to be cycled on and off less frequently than would otherwise be necessary in a direct-supply system. This is important because the electrical and mechanical transients that are generated during a motor/compressor start-up event may severely challenge the compressor motor and associated electrical contacts.

The size and operating pressures of the compressor and reservoir in a compressed air system are matters of design choice. A larger, higher-pressure reservoir will reduce the duty cycle of the compressor motor, but there are associated cost, size and weight constraints that must be considered. Furthermore, the control system set points used to control the compressor starts and stops may be varied within overall system limits. Compressed air systems for locomotives are designed with the benefit of experience accumulated during the operation of generations of locomotives. However, in spite of the optimization of system design, there have been instances of specific operating conditions unique to a particular locomotive or group of locomotives that result in an undesirably high duty cycle for the air compressor motor. Because such locomotive-specific conditions may be transient and may not be representative of conditions experienced by an entire fleet of locomotives, it is not necessarily desirable to further refine the compressed air system components in response to such conditions. Thus, a compressed air system that is less susceptible to excessive cycling of the compressor motor is desired.

DETAILED DESCRIPTION OF THE INVENTION

Figure 1:
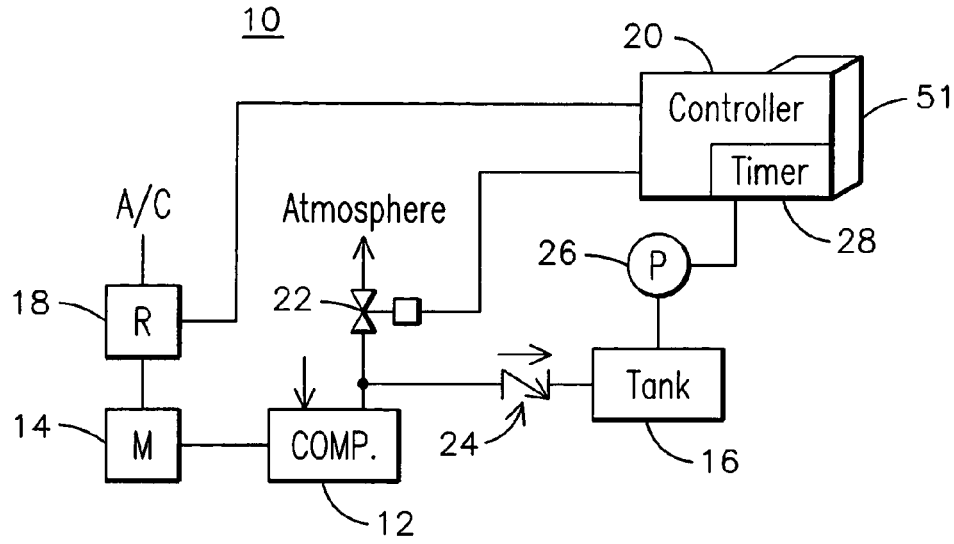
FIG. 1 is a schematic diagram of a compressed air system.

An improved compressed air system 10 as may be used on a locomotive or other application is illustrated in FIG. 1. The system includes a compressor 12 that is driven by an electrical motor 14 to provide a flow of compressed air to a reservoir or storage tank 16. A power supply may be coupled through a relay 18 or other such electrical switching device to energize the motor 14. The relay 18 is selectively positioned to energize or to de-energize the motor 14 in response to a motor control signal generated by a controller 20. The flow of compressed air is directed to the reservoir 16 when a bypass valve 22 in the compressed air supply line is closed, i.e. in a compressor loaded position or mode. The flow of compressed air is vented to atmosphere when the bypass valve 22 is open, i.e. in a compressor unloaded position or mode. A check valve 24 prevents compressed air in the tank 16 from escaping through the compressed air supply line. The controller 20 provides a control signal to the bypass valve 22 to command the desired bypass valve position.

The compressed air system of FIG. 1 further includes a pressure transducer 26 for providing a pressure signal responsive to the air pressure in the reservoir 16. The pressure signal is provided as an input to the controller 20, and that signal is used in combination with a time parameter measured by a timer 28 to determine a parameter related to pressure in the reservoir, as will be discussed more fully below.

Figure 2:
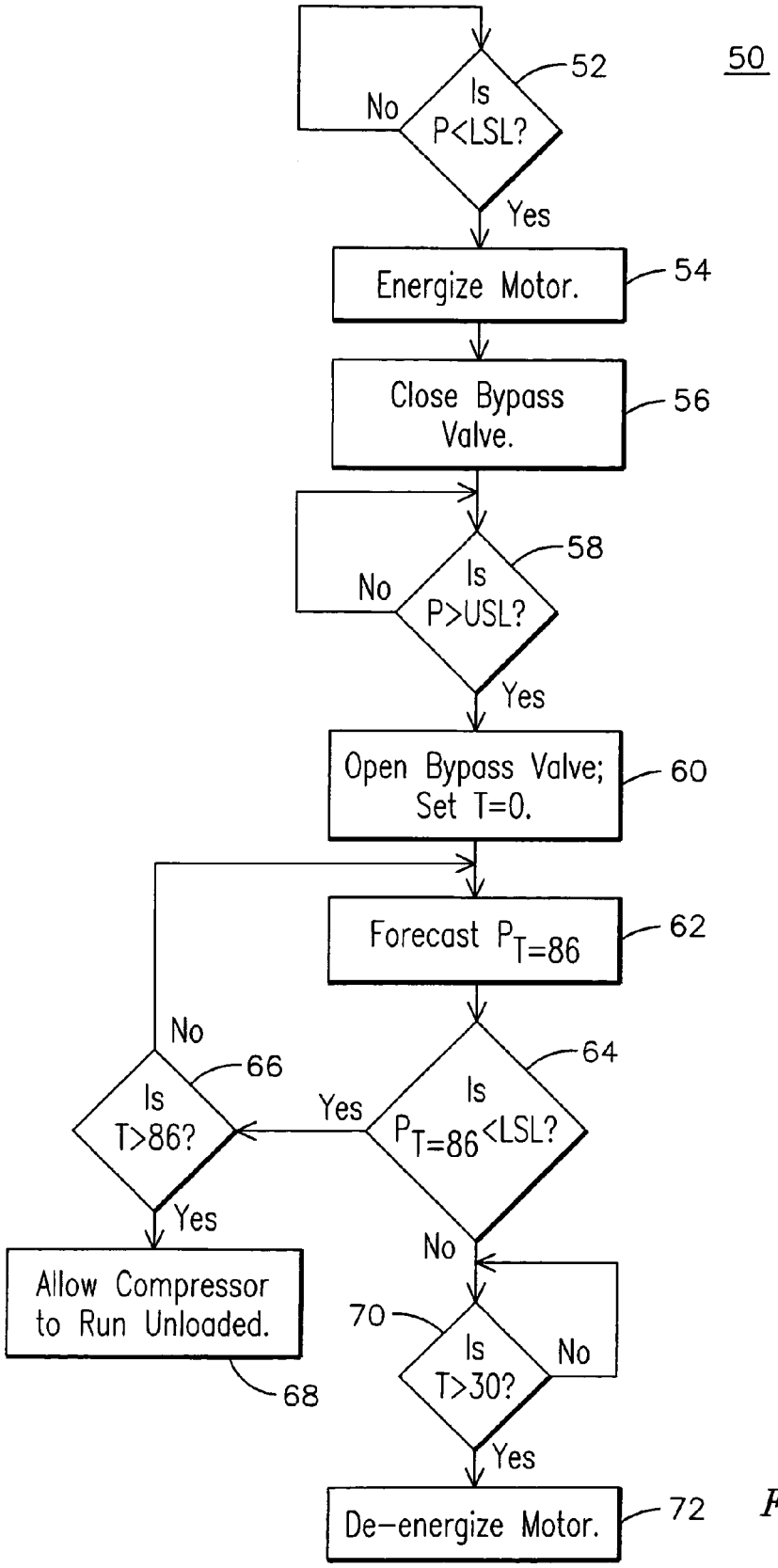
FIG. 2 illustrates the steps embodied in logic in the controller of the compressed air system of FIG. 1.

FIG. 2 illustrates exemplary steps in a method 50 that may be implemented by logic executed in the controller 20 (FIG. 1) in a control module 51 to reduce the duty cycles experienced by the compressor motor. Such logic may be stored in a memory device and/or embodied in software or firmware, and the controller may be a personal computer, a digital or analog processor, or other such device known in the art. The method may begin with a decision step 52 wherein the pressure in the reservoir (P), as measured by the pressure transducer 26 (FIG. 1), is compared to a predetermined lower specification limit (LSL) set point. If the actual pressure has dropped below the lower set point, the controller 20 will produce an appropriate motor-on signal to position the relay 18 to energize the motor at step 54. At this point the bypass valve 22 (FIG. 1) is open and the motor 14 starts the compressor 12 in an unloaded mode. A predetermined time later, such as approximately 2 seconds later once the compressor has come up to speed, the controller 20 will produce a valve-close signal at step 56 to position the bypass valve to load the compressor. The compressor will deliver a flow of compressed air to the reservoir until, as determined at decision point 58, the pressure P in the reservoir exceeds an upper specification limit (USL) set point, at which time the bypass valve will be signaled to open to place the compressor in the unloaded mode and a timer function will be set to T=0, as indicated at step 60. It is known to run the compressor in the unloaded mode for a predetermined cool down period, typically 30 seconds, following its operation in the loaded mode in order to cool the compressor head and motor relay contacts. A method embodying aspects of the present invention will allow the compressor to run in the unloaded mode for a longer period of time when a measured parameter indicates a likelihood that the flow of compressed air from the compressor will again be required within a selected time period.

One embodiment of the present invention utilizes the reservoir pressure decay rate to forecast the pressure in the reservoir at a future point in time, as indicated at step 62, and if, as indicated at steps 64 and 66, the value of the predicted pressure at that future point in time is less than the lower specification limit set point, the compressor is allowed to run in the unloaded mode beyond the normal cool down time period, as indicated at step 68. For example, measuring the pressure in the reservoir at two different times, such as at 9-second intervals, and then dividing the difference in those two pressures by the time interval will calculate an average pressure decay rate. The average pressure decay rate is then extrapolated to a future point in time, for example to a time 86 seconds after the start of the cool down period (T=86 seconds). If, as determined at decision point 64, the forecast pressure ($P_T$=86) is greater than the lower specification limit set point, then, as indicated at steps 70 and 72, the motor is allowed to be de-energized at the end of the normal 30-second cool down period. If, however, the forecast pressure ($P_T$=86) is less than the lower specification limit set point, the motor is allowed to run in the unloaded mode until otherwise commanded. That is, the compressor is allowed to run in the unloaded mode for a first cool down period. In this case, when the pressure P does actually drop below the lower set point limit, the compressor is still running and can be quickly placed in the loaded mode by simply commanding the bypass valve to close, thus reducing the duty cycle on the compressor motor. Such a method is responsive to situations wherein the pressure in the reservoir is being consumed at a rate that would otherwise result in excessive starts and stops of the compressor motor, while still allowing the normal 30-second unloaded cool down period to be used when the pressure drop in the reservoir is at normal lower rates. That is, in this case the motor is deenergized at the end of a second cool down period. Prior art systems and methods of control that relied solely upon pressure set points were unresponsive to rates of pressure change and therefore were unable to provide the responsiveness of the present invention.

Figure 3:
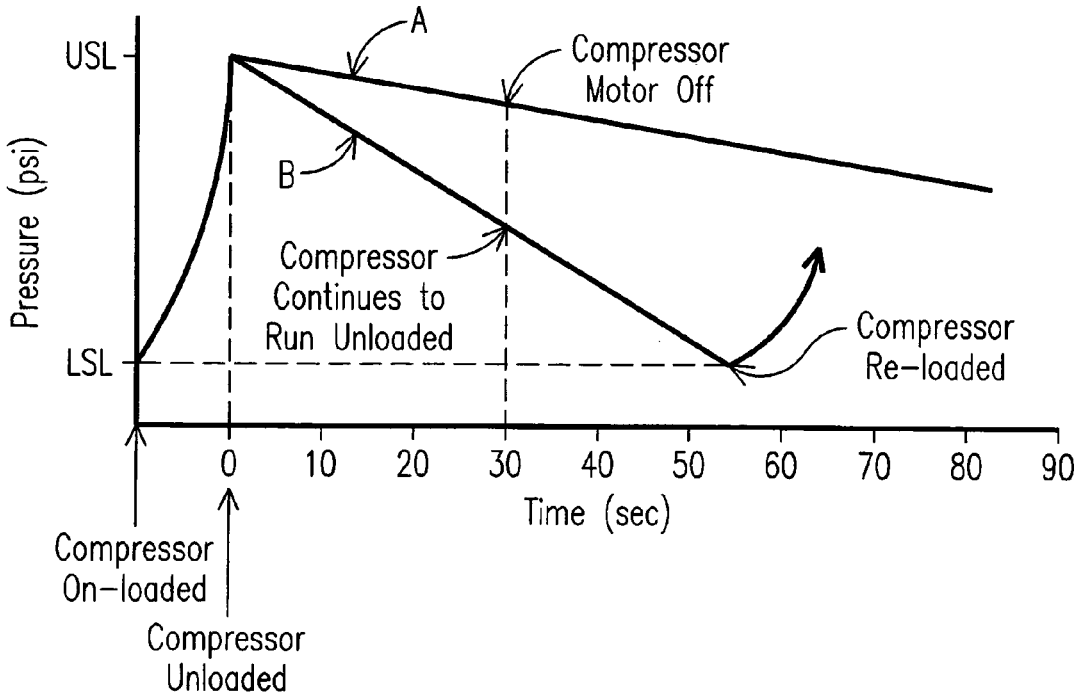
FIG. 3 illustrates pressure verses time for two different operating conditions in the compressed air system of FIG. 1.

FIG. 3 illustrates a plot of exemplary pressures in the reservoir versus time for two different situations in the system of FIG. 1 as may be controlled by the method of FIG. 2. At the far left side of FIG. 3 the pressure is increasing over time while the compressor is running in the loaded mode. At time T=0 the upper specification limit is reached and the bypass valve is opened while the compressor continues to run in the unloaded mode. Curve A represents a situation wherein the demand for compressed air is relatively low and the pressure within the reservoir decays at a relatively slow rate. In this situation, the average pressure decay rate extrapolated to T=86 seconds would predict the pressure to remain above the lower specification limit, therefore the compressor motor is turned off at the end of the 30-second cool down period. Curve B represents the situation wherein the demand for compressed air is relatively high and the pressure within the reservoir decays at a relatively fast rate. In this situation, the average pressure decay rate extrapolated to T=86 seconds would predict the pressure to be below the lower specification limit, therefore the compressor motor is allowed to run in the unloaded mode at the end of the 30-second cool down period. When the pressure finally drops below the lower specification limit set point at about T=58 seconds, the compressor is returned to the loaded mode by closing the bypass valve without having to re-energize the compressor motor.

The speed of modern processors allows such calculations to be performed many times per second, e.g. every 100 milliseconds. In one exemplary embodiment controller 20 may calculate a rolling nine-second average pressure decay rate to successively update the pressure forecast for a predetermined point in time. The future point in time for the forecast may be selected with consideration to historical operating data for such systems, and/or it may be selected for ease of hardware implementation.

One may appreciate that other parameters related to the decay of pressure in the reservoir may be used. For example, other embodiments may be envisioned wherein a first or other derivative of pressure versus time may be used in the control logic. In still other embodiments, the rate of pressure decay may be extrapolated over a variable time period in response to different operating conditions or modes of the locomotive or compressed air supply system. Such extrapolations may be linear or non-linear. In its most general form, the present invention embodies a strategy to forecast the next request to turn on the compressor drive motor, and if that request is forecast to be within a sufficiently short time period, then the compressor is allowed to run in the unloaded mode to reduce the duty cycle and to prolong component life expectancy.

Aspects of the present invention can be embodied in the form of computer-implemented processes and apparatus for practicing those processes. Aspects of the present invention can also be embodied in the form of computer program code containing computer-readable instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. Aspects of the present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose computer, the computer program code segments configure the computer to create specific logic circuits or processing modules. Other embodiments may be a microcontroller, such as a dedicated micro-controller, a Field Programmable Gate Array (FPGA) device, or Application Specific Integrated Circuit (ASIC) device.

While preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A compressed air system for a railroad locomotive comprising:

an air compressor;

an electric motor for driving the air compressor;

an air reservoir for receiving air under pressure from the air compressor;

a valve for venting air under pressure from the air compressor;

a sensor for measuring a parameter indicative of the pressure of the air in the air reservoir; and a controller for controlling the operation of the electric motor and valve for:

initiating operation of the electric motor to drive the air compressor when air in the reservoir falls below a lower predetermined level to deliver air under pressure to the reservoir;

opening the valve to terminate delivery of air under pressure to the reservoir when the air pressure in the reservoir exceeds an upper predetermined level;

with the air pressure in the reservoir at or near the upper predetermined level, forecasting when the operation of the electric motor to drive the air compressor will next be initiated;

if the forecast initiation is set to occur within a predetermined period of time, continuing to operate the electric motor to drive the air compressor while maintaining the valve open to vent the compressed air delivered by the air compressor, the motor operation being continued until the pressure of the air in the reservoir drops to the lower predetermined levels and then closing the valve to direct the air under pressure delivered by the air compressor to the reservoir; and if the forecast initiation is set to occur after a predetermined period of time, terminating operation of the electric motor driving the air compressor until the pressure of the air in the reservoir drops to the lower predetermined level.

2. A compressed air system comprising:

a compressor;

a motor for driving the compressor;

a reservoir for storing air compressed by the compressor;

a bypass valve for selectively directing compressed air produced by the compressor to one of the reservoir and the atmosphere;

a pressure transducer producing a pressure signal responsive to air pressure in the reservoir;

a controller coupled to the pressure transducer, the bypass valve and the motor; and a control module in the controller for controlling the motor and the bypass valve and responsive to a rate of change of pressure in the reservoir.

3. The compressed air system of claim 2, wherein said control module is configured to operate the compressor in the loaded mode to increase air pressure in the reservoir to a predetermined upper value, said control module further configured to determine a parameter responsive to a change in the air pressure in the reservoir over a period of time, and to use the parameter to decide whether or not to operate the compressor in the unloaded mode for a predefined first cool down period after the air pressure in the reservoir reaches the predetermined upper value.

4. The air compressed system of claim 3, wherein the control module is configured to determine said parameter by determining a rate of decrease in air pressure in the reservoir over time.

5. The air compressed system of claim 4, wherein the control module is configured to process the rate of decrease in air pressure to predict an air pressure value in the reservoir at a future point in time.

6. The air compressed system of claim 5, wherein the control module is configured to process the predicted air pressure to determine whether or not to de-energize the motor at the end of a predefined second cool down period.

7. The air compressed system of claim 6, wherein said first cool down period is longer relative to said second cool down period.

8. The air compressed system of claim 5, wherein the control module is configured to compare the predicted value of air pressure relative to a predetermined lower value of air pressure in the reservoir.

9. The air compressed system of claim 8, wherein when the predicted value of air pressure is more than the predetermined lower value, the control module is configured to de-energize the motor at the end of the predefined second cool down period.

10. The air compressed system of claim 8, wherein when the predicted value of air pressure is less than the predetermined lower value, the control module is configured to operate the compressor in the unloaded mode for the predefined first cool down period.

11. A compressed air system comprising:

a compressor;

a motor for driving the compressor;

a reservoir for storing air compressed by the compressor;

a bypass valve for selectively directing compressed air produced by the compressor to one of the reservoir and the atmosphere; and a controller coupled to the bypass valve and the motor, said controller configured to forecast a next request for turning on a compressor motor, wherein, if that request is forecast to be within a sufficiently short time period, said controller configured to allow the compressor to run in the unloaded mode, thereby reducing an operational duty cycle of said compressed air system.

* * * * *